United States Patent [19]

Skurko

[11] 3,964,542

[45] June 22, 1976

[54] APPARATUS FOR CONTINUOUSLY CASTING METAL NUGGETS

[76] Inventor: Richard Skurko, c/o Garfield Company, Inc.,21862 Cromwell Ave., Fairview Park, Ohio 44126

[22] Filed: Dec. 13, 1974

[21] Appl. No.: 532,627

[52] U.S. Cl. ..... 164/329; 164/82; 164/130

[51] Int. Cl.[2] ..... B22D 5/04; B22D 11/06

[58] Field of Search ..... 164/70, 78, 130, 136, 164/129; 249/52
164/129, 154, 155, 156, 262, 279, 324, 328, 329, 336; 249/52

[56] References Cited

UNITED STATES PATENTS

| | | | |
|---|---|---|---|
| 883,253 | 3/1908 | Steese | 164/329 |
| 1,319,673 | 10/1919 | Stephenson | 164/279 X |
| 1,354,975 | 10/1920 | Hurst | 164/329 |
| 1,435,007 | 11/1922 | Hurst | 164/329 X |
| 2,167,883 | 8/1939 | Ferree | 164/329 |
| 2,199,598 | 5/1940 | Robbins | 164/324 |
| 2,439,875 | 4/1948 | Steudel | 164/329 |
| 3,015,137 | 1/1962 | Hoebing | 164/136 X |
| 3,052,934 | 9/1962 | Kerber | 164/329 |
| 3,512,575 | 5/1970 | Bowden | 164/328 X |
| 3,627,019 | 12/1971 | Hitchcock | 164/130 |

*Primary Examiner*—Francis S. Husar
*Assistant Examiner*—John S. Brown
*Attorney, Agent, or Firm*—Meyer, Tilberry & Body

[57] ABSTRACT

A plurality of conveyorized molds, having nugget cavities which are deep compared to their width, are passed beneath a continuously pouring stream of nonferrous molten metal at a rate of speed such that the cavities are only partially filled to prevent bridging over and freezing together of nuggets in consecutive cavities. Bridging over is further prevented by providing a knife edge surface between consecutive cavities wherein the stream is split between said cavities in such a manner that it is received substantially all within the mold cavities, there being little or no accumulation of metal on the surface of the mold cavities. This apparatus and method of pouring minimizes wetting of the vertical wall portions of the cavities, whereby uniformly shaped nuggets are formed without attendant formation of undesirable risers, sprues or tails which cannot be easily or inexpensively removed from the nuggets.

16 Claims, 10 Drawing Figures

FIG. 6
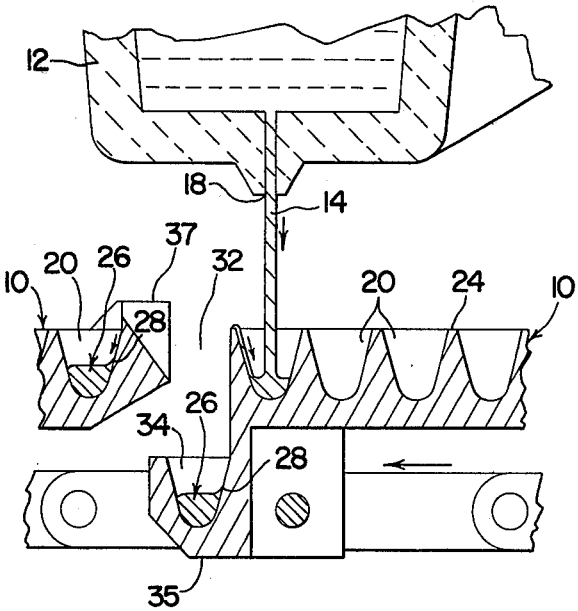
FIG. 7
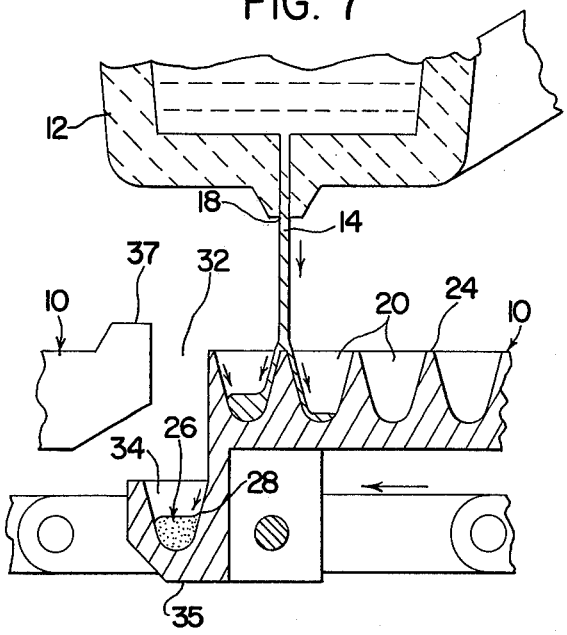
FIG. 8
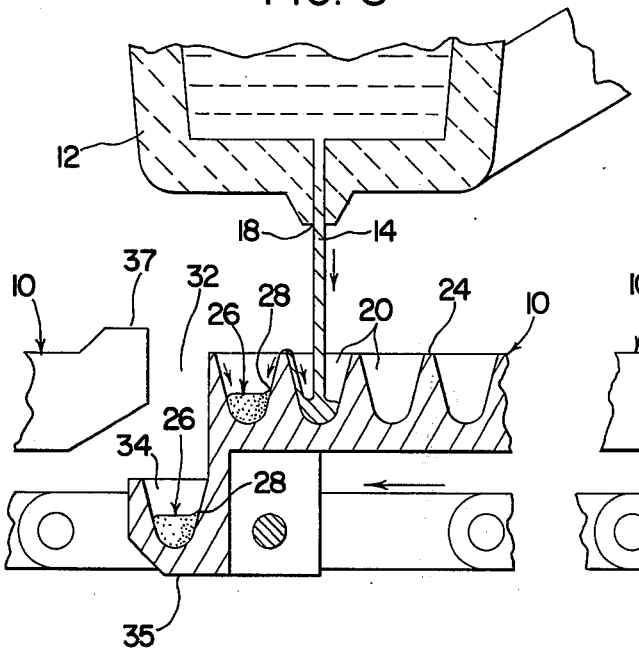
FIG. 9
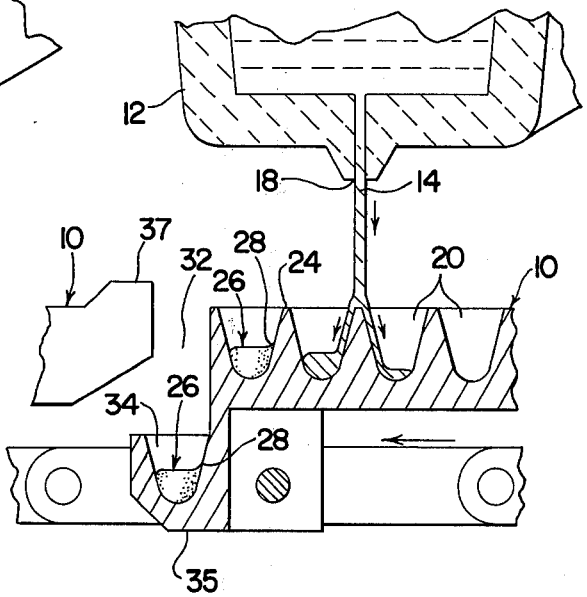
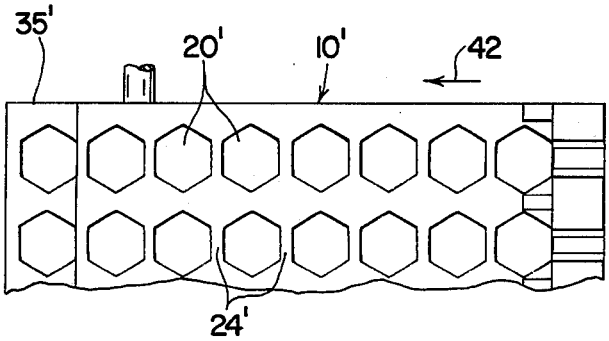
FIG. 10

APPARATUS FOR CONTINUOUSLY CASTING METAL NUGGETS

THE PRIOR ART

This invention relates to a method and apparatus for casting non-ferrous metal nuggets of the type employed in the steel making industry to de-oxidize steel. For nuggets to be acceptable for this purpose, they must be substantially uniform in size and weight, and it is also desirable that they be of uniform configuration. Robbins U.S. Pat. No. 2,199,598, Kerbert U.S. Pat. No. 3,052,934, Tachimoto U.S. Pat. No. 3,429,362, and Bowen U.S. Pat. No. 3,512,575 are illustrative of the state of the prior art as known to me, and over which I believe my invention to be a patentable improvement.

Nugget pouring methods and apparatus must be fast, economical, accurate, and preferably performed with relatively inexpensive maintenance free equipment. Practically all presently known nugget pouring devices include a source of molten metal and means to pour this metal into conveyorized molds having a plurality of cavities in each mold. The molds are secured to an endless conveyor which transports each mold to the source of molten metal, and normally these molds are transported endlessly in a vertical plane whereby means are provided to remove the nuggets when the molds are inverted from the pouring position.

OBJECTS OF THE INVENTION

It is an object of my invention to provide a method and apparatus for pouring nuggets in mold cavities wherein the size of the nugget can be easily but accurately controlled.

It is another object of my invention to provide a method and apparatus for pouring nuggets which reduces the problem of scrap losses caused by molted metal bridging over from cavity to cavity and freezing to thereby bond two or more nuggets together.

It is yet another object of my invention to provide a method and apparatus for pouring nuggets which reduces the problem of scrap losses caused by molten metal spilling between molds.

It is also an object of my invention to provide a method and apparatus for pouring nuggets wherein each nugget is of uniform size, weight and configuration.

It is a further object of my invention to provide a method of pouring nuggets which eliminates objectionable appendages to the nuggets, variously referred to as tails, sprues, or risers, which must be removed from the nuggets in order for the nuggets to be saleable.

It is a still further object of my invention to provide nugget pouring apparatus which is relatively maintenance free, inexpensive to build, to operate and to maintain.

It is yet a still further object of my invention to provide an improved nugget pouring apparatus in which there is no loss of metal between consecutive molds.

Other objects, advantages and features will be apparent from the description which follows from the accompanying drawings in which:

FIG. 7 is a fragmentary sectional view of the apparatus similar to FIG. 6, and showing the transition of pouring from the first regular row of cavities to the second regular row of cavities.

FIG. 8 is a fragmentary sectional view of the apparatus similar to FIG. 6, and showing the completion of pouring in the first regular row of cavities and continued pouring in the second regular row of cavities.

FIG. 9 is a fragmentary sectional view of the apparatus similar to FIG. 6, and showing the transition of pouring from the second regular row of cavities to the third regular row of cavities; and FIG. 10 is a fragmentary plan view of another embodiment of a mold used in the practice of the invention.

Figures 1, 2, 3:
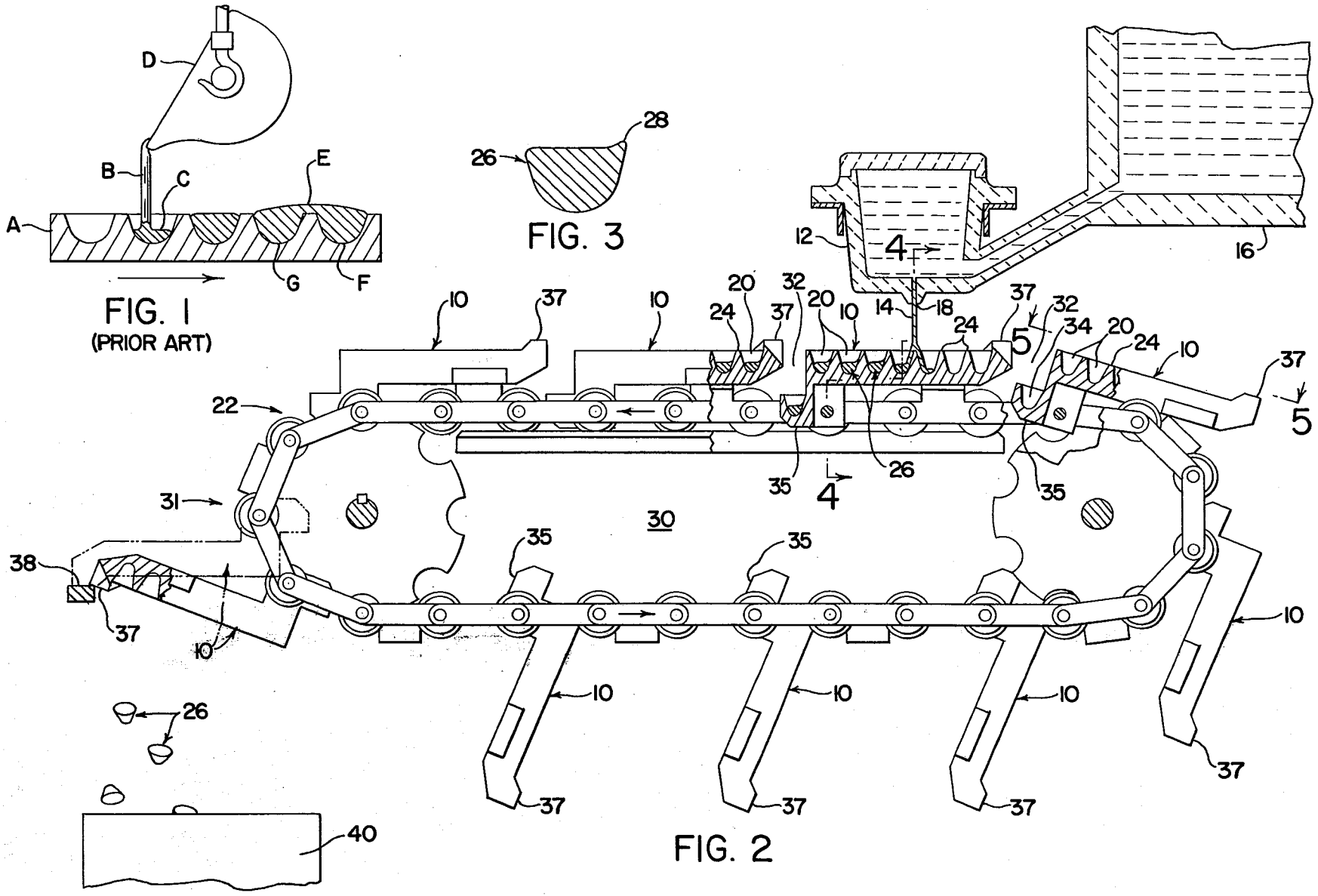
FIG. 1 (PRIOR ART)
FIG. 1 is a sectional schematic representation of a prior art method of pouring nuggets.
FIG. 2 is an elevational view, partially in section of a preferred embodiment of the apparatus for practicing the invention.
FIG. 3 is a sectional view of a nugget made in accordance with the invention.

Referring now to FIG. 1 of the drawings, wherein is shown schematically a nugget mold A which is being automatically transported from left to right and non-ferrous molten metal, such as aluminum, B is being poured into each mold cavity, such as at C, with a hand ladle D. However, pouring by hand is tedious work, necessarily conducted in the presence of debilitating sources of heat such as melting furnaces, open cauldrons and the like. Thus, when a workman becomes fatigued he cannot pour as accurately or as quickly as required such that he may overfill a cavity which then bridges over, as at E from cavity F into a following cavity G. The molten metal forming this bridge then freeze in place and interconnects the two nuggets F and G. It is not economically feasible to machine or otherwise remove the bridge E between nuggets and as a consequence both nuggets must be scrapped.

Figure 4:
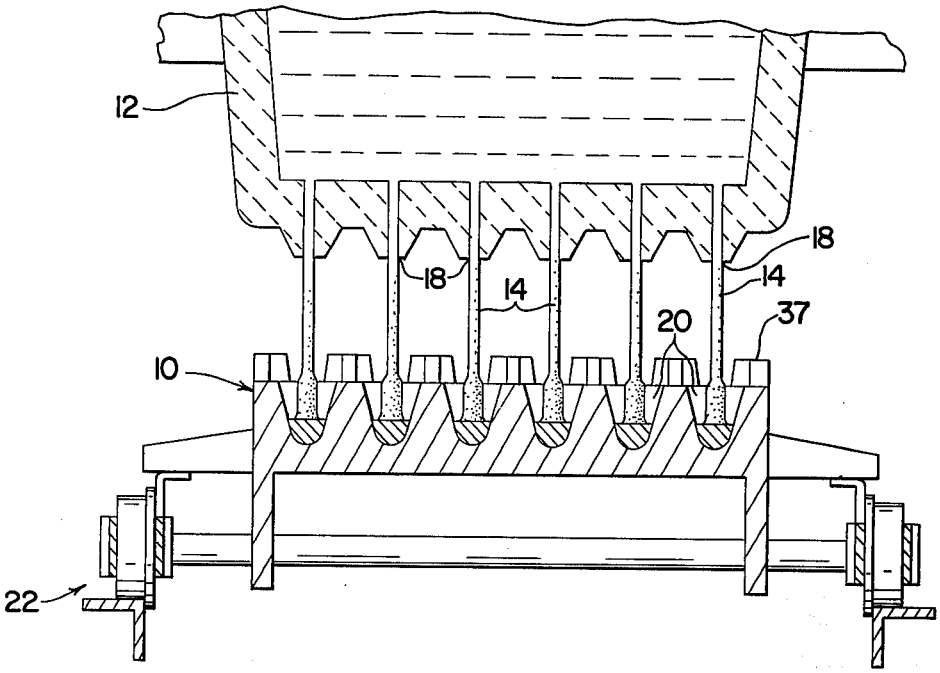
FIG. 4 is a sectional view of a preferred embodiment of the apparatus for practicing the invention taken along line 4—4 of FIG. 2.

Referring now to FIGS. 2 and 4 of the drawings, therein is shown conveyorized molds 10 passing beneath a tundish 12 which is continuously supplied with molten metal 14 from a furnace 16 adjacent thereto. The underside of the tundish is provided with metered orifices 18 from which molten metal 14 is permitted to stream in a continuous fashion. Because the pouring orifices are in the bottom of the tundish, aluminum oxide does not form to obstruct these orifices when the metal being poured is molten aluminum. However, any pouring operation, such as shown in FIG. 1, in which the molten aluminum is poured from the top of the ladle, aluminum oxide accumulation is a constant contamination problem.

As each cavity 20 of each mold 10 is presented therebeneath the rate of speed of the conveyor 22, coupled with the special configuration of the mold cavities 20, accurately meters a predetermined amount of metal into each cavity without an accumulation of metal on the surface 24 of the mold, or the formation of objectionable irregular risers, sprues or tails connected to each nugget. It is not fully understood why this phenomenon occurs. The cavities 20 were originally conceived and designed to be far deeper than their width with the expectation that by only partially filling each cavity with a premetered amount of metal, in view of the shallow draft of the cavities, only a thin risers would adhere to the wall surfaces which could be relatively easily removed by tumbling the nuggets in a subsequent operation. However, when the molds were presented to the continuous stream of molten metal from a tundish, it was discovered that the sidewalls of the cavities did not wet and build up excess unwanted deposits on the walls. Instead, by splitting the stream between cavities, (see FIGS. 6-9) because of gravity, surface tension or for some other reason, the molten metal pulls down into each cavity, leaving only a negligible excess on the surface of the mold, or on the walls of the cavities. As a consequence, the final product 26, as shown in FIG. 3 in cross-section, is fairly compact, of uniform configuration, and has but a small nib 28 into which the molten metal flowing downwardly along the wall surface of the cavity has contracted. This small amount of accumulation is not objectionable and does not therefore have to be removed. A slight thin riser is easily tumbled off if one should form. To further minimize riser formation anti-wetting means may be applied to the walls of the cavities, but this has not been found to be necessary.

Thus, without resorting to complicated mechanisms such as pouring wheels, hydraulic ladle tilting means, or subsequent heavy machining operations, I have been able to successfully manufacture high quality non-ferrous nuggets with a minimum of equipment. My method of manufacturing nuggets is exceedingly simple by virtue of the fact that I have discovered that it is not necessary to intermittently measure predetermined discreet amounts of metal into each mold. Instead, I permit the metal to flow continuously across the surface of the mold and from mold to mold. With my method and apparatus, I have also discovered that metal does not accumulate on the surface of the molds. By controlling the speed of the conveyor and the size of the orifice of the tundish I am able to provide a consistent product which is uniform in size and weight and readily saleable.

With the type of mold which I use with my invention, it is necessary to space the molds 10 sufficiently apart so that they are able to turn at the end of the conveyor 30 at 31 without interference. Accordingly, rather than permit the metal to spill between molds at 32, I provide an extra subjacent row of cavities 34 in mold extension 35 recessed below and forward of each mold and integral thereto so that there is substantially no waste. Furthermore, the positioning of mold extensions 35 forward of each mold provides ample clearance for pivoting at the end 31 of the conveyor 30. The net effect is a continuously pouring operation from mold to mold without loss of metal or time.

Figure 5:
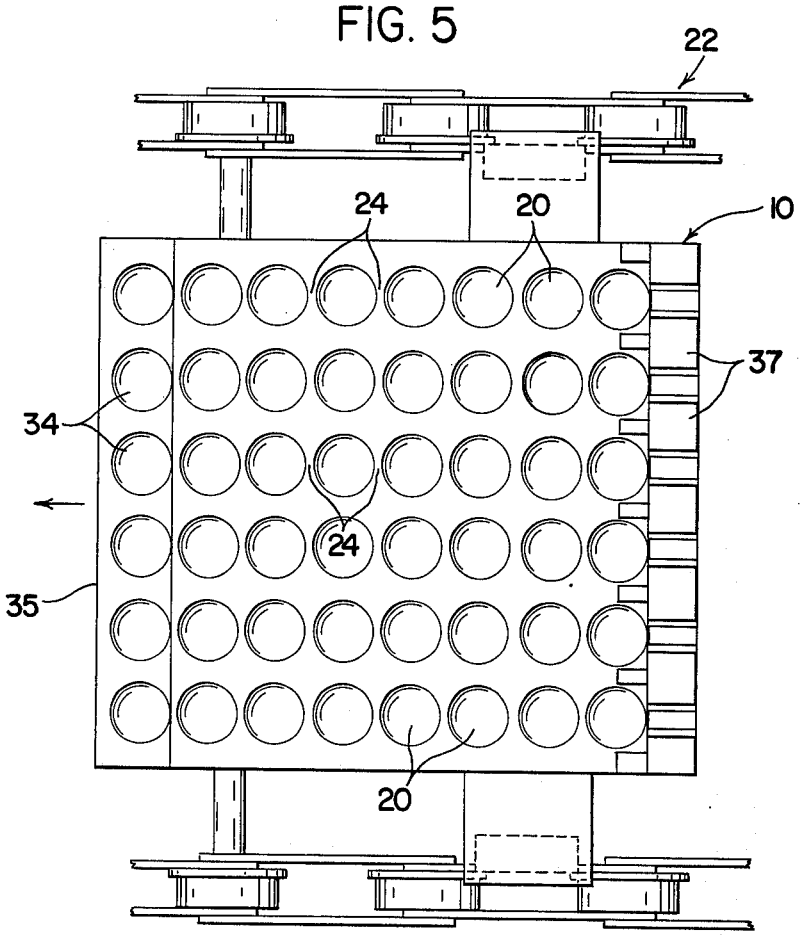
FIG. 5 is a top plan view of a mold used to practice the invention taken along the line 5—5 of FIG. 2, and, FIG. 6 is a fragmentary sectional view of the apparatus generally shown in FIG. 2 and showing the completion of pouring in the subjacent row of cavities and start of the pouring operation in the first regular row of cavities.

It will be observed that a row of spaced-apart upwardly projecting lugs 37 are provided on the back edge of each mold 10. (See FIGS. 4 and 5). The lugs 37 are laterally spaced-apart, as best shown in FIG. 4, to permit the streams of molten metal 14 to pass therebetween and to fill mold extension cavities 34 without interruption. As the leading mold passes from beneath the streams 14 mold extension 35 of the following mold is engaged by and intercepts the streams.

After the nuggets 26 have solidified, the molds 10 are moved to the left end 31 of the conveyor 30 where they are pivotally upset. After the molds are pivoted 180°, the lugs 37 strike a stationary bar 38, the impact of which jars the nuggets loose to fall into a collecting bin 40.

Referring now to FIG. 10, it will be seen that the cavities 20' of the mold 10' may be poly-sided rather than circular in section, wherein each cavity has common side walls 24' with the immediately adjacent preceding and following cavities. The arrow 42 indicates the direction of movement of the mold 10 on the conveyor 30.

The present invention has been described in conjunction with the illustrated preferred embodiment. However, various changes in this embodiment, and other embodiments of the present invention will be obvious to those skilled in the art upon reading and understanding the foregoing description. It is intended to include all such embodiments and modifications of the present embodiments within the present invention insofar as they are within the scope of the appended claims.

I claim:

1. Apparatus for continuously casting individual active metal nuggets comprising:

a. a tundish having a fixed pouring orifice in the bottom thereof to provide a continuous narrow veritical stream of molten metal;

b. means adjacent said tundish for directing molten metal thereto, and c. a plurality of consecutive connected and spaced nugget molds each nugget mold having a plurality of nugget cavities longitudinally aligned for consecutive presentation beneath the fixed pouring orifice of said tundish, said cavities being of substantially greater depth than width and being positioned with respect to each other to minimize the top surface of said mold exposed to said tundish pouring orifice; each said nugget mold further including intercepting means comprising a subjacent stepped portion integrally secured to the front wall of each said mold, the top surface of said stepped portion being positioned beneath the top surface of said molds, and a nugget cavity in said stepped portion in longitudinal alignment with said plurality of nugget cavities whereby the flow of molten metal between consecutive molds is intercepted.

2. The apparatus set forth in claim 1, including several metered pouring orifices transversely aligned in the bottom of said tundish; several rows of said plurality of nugget cavities in each said nugget mold transversely aligned for presentation beneath said several pouring orifices.

3. The apparatus set forth in claim 1 wherein the perimeters of said cavities are in close approximation with the perimeters of adjacent cavities.

4. The apparatus set forth in claim 1, wherein the cross sections of said cavities are circular and the perimeters of said cavities are substantially tangential with the perimeters of adjacent cavities.

5. The apparatus set forth in claim 1, wherein said cavities are poly-sided and positioned so that adjacent cavities have at least one common wall.

6. The apparatus set forth in claim 1, wherein the perimeters of said cavities are substantially knife edged to sharply divide the flow of molten metal between cavities.

7. The apparatus of claim 1, wherein said mold cavities are formed in a plurality of conveyorized molds, said molds being longitudinally aligned, means to intercept said stream of molten metal between molds, and means to transport said molds on an endless conveyor.

8. The apparatus of claim 1, including means to split said molten stream between consecutive mold cavities and to prevent bridging of molten metal between said consecutive cavities.

9. The apparatus of claim 1, wherein said cavities are provided with draft sufficient to permit removal of said nuggets therefrom, but insufficient to permit substantial wetting of the walls of said cavities.

10. The apparatus set forth in claim 1 wherein said plurality nugget molds are connected in an endless loop and each said nugget mold is pivotable away from said loop to contact a stationary bar located adjacent said endless loop.

11. In apparatus for continuously casting metal nuggets having a tundish with a pouring orifice in the bottom thereof; means adjacent said tundish for directing molten metal thereto, and a plurality of consecutive connected and spaced nugget molds, each nugget mold having a plurality of nugget cavities longitudinally aligned for consecutive presentation beneath the pouring orifice of said tundish, the improvement in said mold comprising: a subjacent stepped portion integrally secured to the front wall of said mold, the top surface of said stepped portion being positioned beneath the top surface of said mold, and a nugget cavity in said stepped portion in longitudinal alignment with said plurality of nugget cavities whereby the flow of molten metal between consecutive molds is intercepted.

12. In apparatus for continuously casting metal nuggets having a tundish with a pouring orifice in the bottom thereof; means adjacent said tundish for directing molten metal thereto, and a plurality of consecutive connected end spaced nugget molds, each nugget mold having a plurality of nugget cavities longitudinally aligned for consecutive presentation beneath the pouring orifice of said tundish, the improvement in said mold comprising: the cavities in said mold being of substantially greater depth than width, and a subjacent stepped portion integrally secured to the front wall of said mold, the top surface of said stepped portion being positioned beneath the top surface of said mold, and a nugget cavity in said stepped portion in longitudinal alignment with said plurality of nugget cavities whereby the flow of molten metal between consecutive molds is intercepted.

13. In apparatus for continuously casting metal nuggets having a tundish with a pouring orifice in the bottom thereof; means adjacent said tundish for directing molten metal thereto, and a plurality of consecutive connected nugget molds, each nugget mold having a plurality of nugget cavities longitudinally aligned for consecutive presentation beneath the pouring orifice of said tundish, the improvement in said mold comprising: the cavities in said mold being of substantially greater depth than width and being positioned with respect to each other to minimize the top surface area of said mold exposed to said tundish pouring orifice, and a subjacent stepped portion integrally secured to the front wall of said mold, the top surface of said stepped portion being positioned beneath the top surface of said molds, and a nugget cavity in said stepped portion in longitudinal alignment with said plurality of nugget cavities whereby the flow of molten metal between said consecutive molds is intercepted.

14. In apparatus for continously casting metal nuggets having a tundish with a pouring orifice in the bottom thereof; means adjacent said tundish for directing molten metal thereto, and a plurality of consecutive connected nugget molds, each nugget mold having a plurality of nugget cavities longitudinally aligned for consecutive presentation beneath the pouring orifice of said tundish, the improvement in said mold comprising: the cavities in said mold being positioned with respect to each other to minimize the top surface area of said mold exposed to said tundish pouring orifice, and a subjacent stepped portion integrally secured to the front wall of said mold, the top surface of said stepped portion being positioned beneath the top surface of said molds, and a nugget cavity in said stepped portion in longitudinal alignment with said plurality of nugget cavities whereby the flow of molten metal between said consecutive molds is intercepted.

15. The improvement in apparatus for continuously casting metal nuggets comprising:

a. a tundish having a metered pouring orifice in the bottom thereof;

b. means adjacent said tundish for directing molten metal thereto;

c. a plurality of consecutive connected nugget molds, each nugget mold having a plurality of nugget cavities longitudinally aligned for consecutive presentation beneath the pouring orifice of said tundish, and d. a subjacent stepped portion integrally secured to the front wall of said mold, the top surface of said stepped portion being positioned beneath the top surface of said mold, and a nugget cavity in said stepped portion in longitudinal alignment with said plurality of nugget cavities whereby the flow of molten metal between molds is intercepted.

16. The improvement in apparatus for continuously casting metal nuggets comprising:

a. a tundish having a metered pouring orifice in the bottom thereof;

b. means adjacent said tundish for directing molten metal thereto;

c. a plurality of consecutive connected nugget molds, each nugget mold having a plurality of nugget cavities longitudinally aligned for consecutive presentation beneath the pouring orifice of said tundish, and being positioned with respect to each other to minimize the top surface area of said mold exposed to said tundish pouring orifice, and d. a subjacent stepped portion integrally secured to the front wall of said mold, the top surface of said stepped portion being positioned beneath the top surface of said mold, and a nugget cavity in said stepped portion in longitudinal alignment with said plurality of nugget cavities whereby the flow of molten metal between molds is intercepted.

* * * * *